US007273394B1

(12) United States Patent
English

(10) Patent No.: US 7,273,394 B1
(45) Date of Patent: Sep. 25, 2007

(54) RIGHT ANGLE COAXIAL CONNECTOR

(75) Inventor: James English, Bainbridge, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/282,043

(22) Filed: Nov. 17, 2005

(51) Int. Cl.
*H01R 9/05* (2006.01)

(52) U.S. Cl. ..... 439/582; 439/585

(58) Field of Classification Search ..... 439/582, 439/578, 579, 581, 585, 902
See application file for complete search history.

(56) References Cited

U.S. PATENT DOCUMENTS

| | | | | |
|---|---|---|---|---|
| 3,141,718 | A | 7/1964 | Schott et al. | |
| 3,432,798 | A * | 3/1969 | Brishka | 439/322 |
| 3,480,722 | A * | 11/1969 | Van Horssen et al. | 174/87 |
| 3,954,321 | A | 5/1976 | Casper | |
| 4,066,324 | A | 1/1978 | Stephens | |
| 4,173,386 | A | 11/1979 | Kauffman et al. | |
| 5,037,329 | A | 8/1991 | Wright | |
| 5,184,965 | A | 2/1993 | Myschik et al. | |
| 5,494,454 | A | 2/1996 | Johnsen | |
| 6,283,790 | B1 * | 9/2001 | Idehara et al. | 439/582 |
| 6,648,684 | B2 * | 11/2003 | Tang | 439/582 |
| 6,817,899 | B1 * | 11/2004 | Zerebilov | 439/582 |
| 7,131,858 | B1 * | 11/2006 | Zerebilov | 439/446 |
| 2003/0143893 | A1 * | 7/2003 | Hall et al. | 439/582 |
| 2004/0058582 | A1 * | 3/2004 | Wendling et al. | 439/582 |
| 2004/0219832 | A1 | 11/2004 | Johnsen | |
| 2005/0042920 | A1 | 2/2005 | Poiraud | |

FOREIGN PATENT DOCUMENTS

| | | |
|---|---|---|
| EP | 0 398 770 | 11/1990 |
| FR | 2 675 640 | 10/1992 |
| JP | 6-275344 | 9/1994 |
| WO | WO93/19498 | 9/1993 |
| WO | WO94/02976 | 2/1994 |
| WO | WO94/02977 | 2/1994 |

* cited by examiner

*Primary Examiner*—Hien Vu
(74) *Attorney, Agent, or Firm*—Harness, Dickey & Pierce, PLC

(57) ABSTRACT

A connector is provided. The connector can include a coaxial cable segment. The connector can also include a first housing defining a first cavity and a second cavity that intersects the first cavity. The coaxial cable segment can be received into the first cavity through the second cavity and can exit the first housing through the second cavity. The connector can include a second housing having a conductive sleeve. The second housing can be received into the first housing such that the conductive sleeve exits the first housing through the second cavity and electrically engages the coaxial cable. The coaxial cable can be received within the conductive sleeve and the conductive sleeve of the second housing can be disposed concentrically about the coaxial cable.

15 Claims, 5 Drawing Sheets

RIGHT ANGLE COAXIAL CONNECTOR

FIELD

The present invention relates to connector systems, and more particularly to a right angle coaxial connector.

BACKGROUND

Coaxial cables can be used in various applications, such as cellular phone technologies or other communications applications that involve the transmission of high frequency signals. Generally, coaxial cables are coated with a jacket or shielding that prevents interference with the high frequency signals transmitted therein from exterior noise, such as radio frequencies. The shielding, however, can be relatively inflexible, making it somewhat difficult to position the cable in tight spaces. As such, it can be difficult to couple the coaxial cable to devices that, due to size or space limitations, require the coaxial cable to bend or form right angles to make a connection.

Various connectors can enable the coaxial connector to bend; however, most of these connectors require a soldered joint to form the bend. The use of a soldered joint can be time consuming and may also reduce the quality of the transmission through the soldered joint since it can be difficult to control the impedance of this soldered joint. Accordingly, it may be desirable to provide a right angle connector for a coaxial cable that does not require a soldered joint.

SUMMARY

The teachings of the present invention can provide a connector with a coaxial cable segment for transmitting energy therethrough. The coaxial cable segment can include a center conductor, an outer conductor disposed about the center conductor, an inner insulator disposed between the center conductor and the outer conductor, and an outer insulator disposed about the outer conductor. The coaxial cable segment can also have an end portion wherein at least a portion of the outer insulator is stripped from the outer conductor and wherein the center conductor extends outwardly away from a point at which inner insulator terminates. The connector can also include a first housing defining a first cavity and a second cavity that intersects the first cavity. The end portion of the coaxial cable segment can be received into the first cavity through the second cavity and can exit the first housing through the second cavity. The connector can include a second housing having a conductive sleeve. The second housing can be received into the first housing such that the conductive sleeve exits the first housing through the second cavity and electrically engages the outer conductor of the end portion of the coaxial cable. The inner insulator of the end portion of the coaxial cable can be received within the conductive sleeve and the conductive sleeve of the second housing can be disposed concentrically about the central conductor of the end portion of the coaxial cable.

The present teachings can also provide a method of forming an angled connection with a coaxial cable. The method can include providing a first housing defining a first cavity and a second cavity, a second housing defining a sleeve, and a central conductor disposed in the first housing. The method can include inserting the central conductor into the first cavity. Next, the method can provide for removing a portion of an outer insulator of the coaxial cable to expose an outer conductive layer, an inner insulator layer and a central conductive layer, and positioning the central conductive layer of the coaxial cable within the central conductor. Then, the method can include positioning the central conductive layer of the coaxial cable within the central conductor. The method can include bending the portion of the outer conductive layer extending beyond the central conductor to a desired angle and inserting the second housing into the second cavity so that the sleeve of the second housing is disposed between the outer conductive layer and an inner insulator layer of the coaxial cable. Then, the method can include mechanically coupling the outer conductive layer to the second housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF VARIOUS EMBODIMENTS

The following description of the various embodiments is merely exemplary in nature and is in no way intended to limit the teachings of the various embodiments, their application, or uses. Although the following description is related generally to a right angle connector that can be used to facilitate the transmission of high frequency signals through, for example, a coaxial cable, it will be understood that the right angle connector, as described and claimed herein, can be used with any appropriate application. Therefore, it will be understood that the following discussions are not intended to limit the scope of the appended claims.

Figure 1:
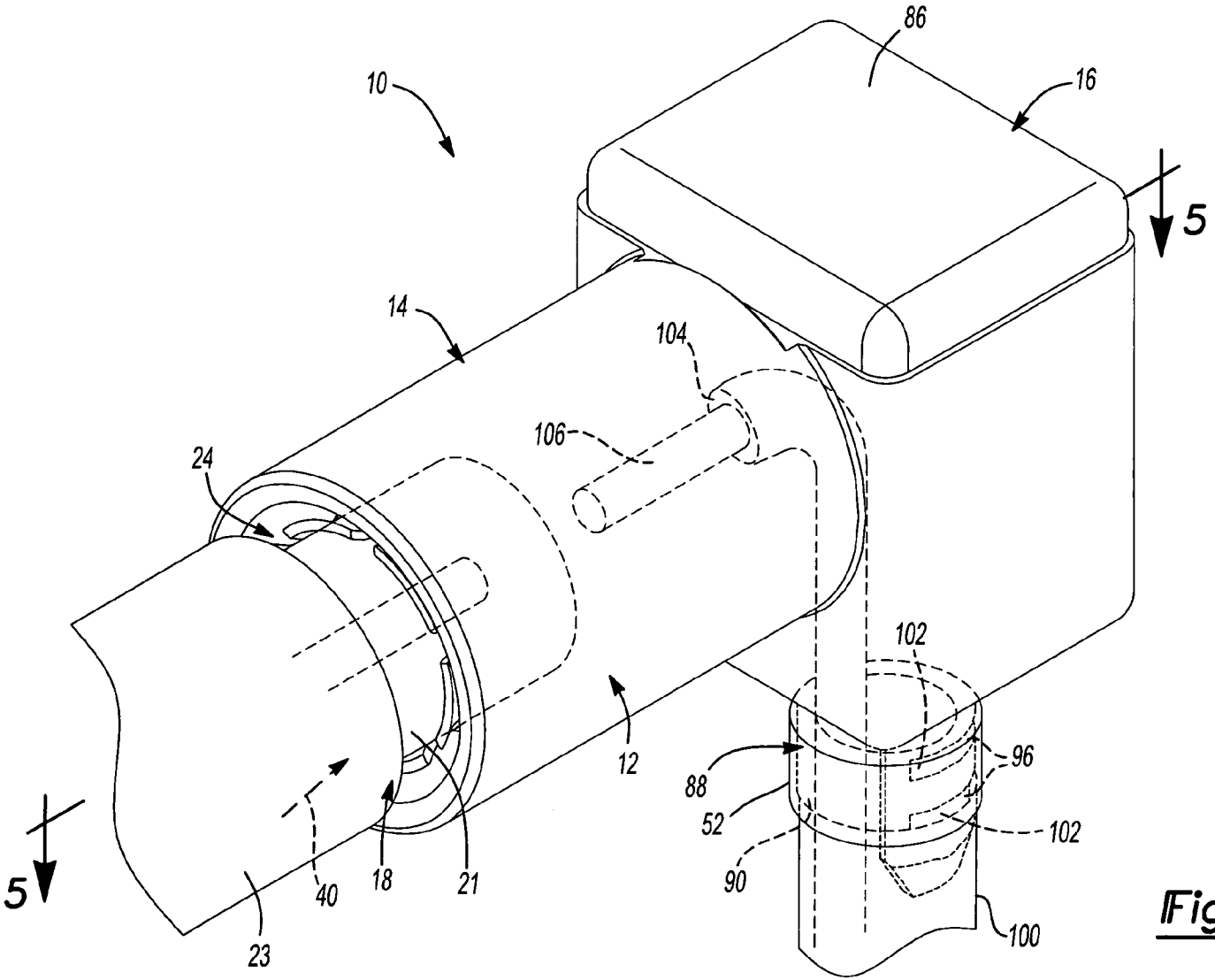
FIG. 1 is an environmental view of a right angle coaxial connector employed with an exemplary coaxial cable.

With reference to FIG. 1, an exemplary right angle coaxial connector 10 is shown in operative association with a coaxial cable 12. The right angle coaxial connector 10 can include a main or first housing 14 and a secondary or second housing 16 for receipt of the coaxial cable 12.

Figure 2:
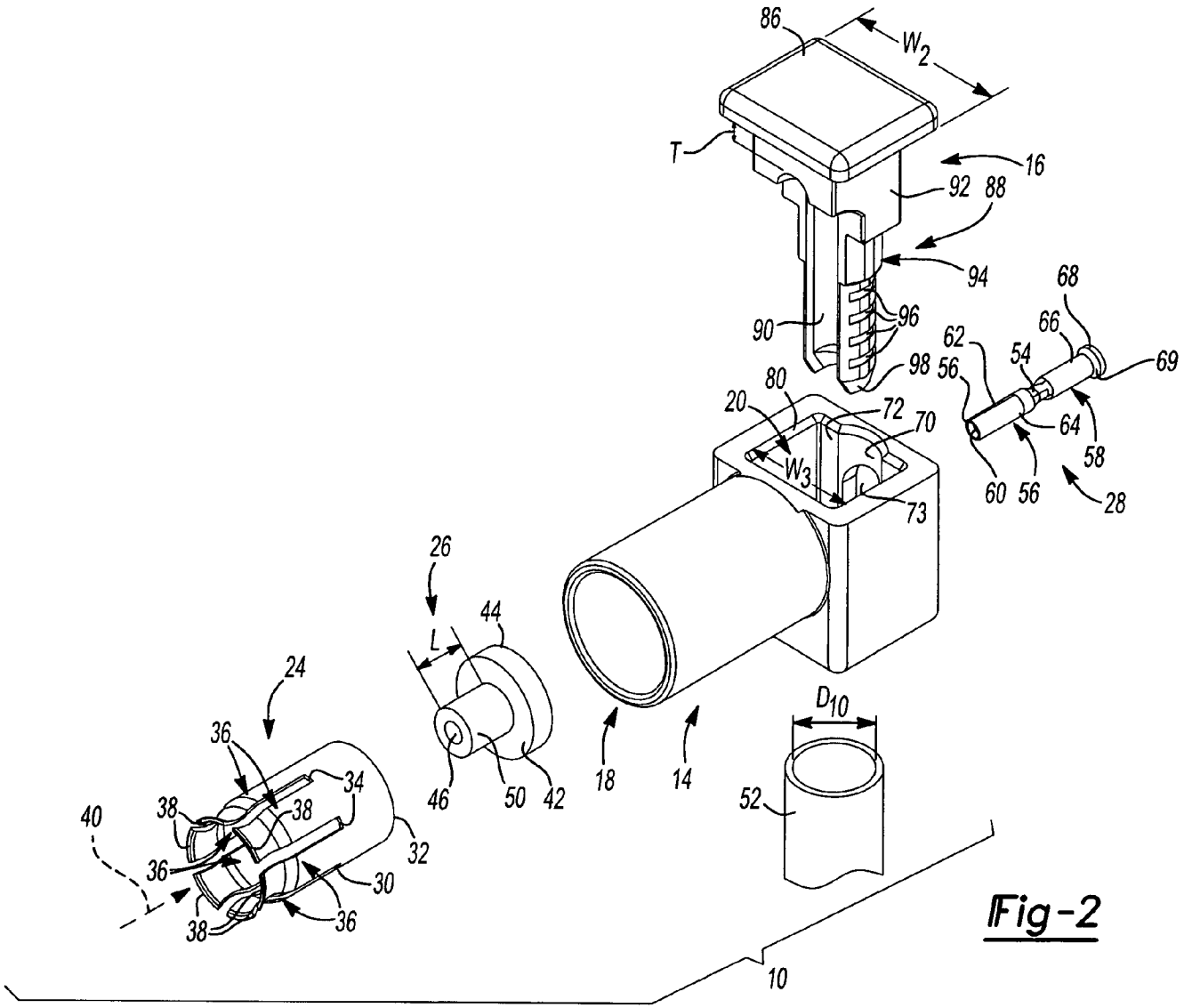
FIG. 2 is an exploded view of the right angle coaxial connector of FIG. 1.

With additional reference to FIG. 2, the first housing 14 can define a first cavity 18 and a second cavity 20. The first housing 14 can be composed of any appropriate conductive material, such as zinc, and can be formed by die-casting; however, any appropriate forming technique could be used, such as machining. The first cavity 18 and second cavity 20 can generally be cast with the first housing 14; however, the first cavity 18 and second cavity 20 could be formed in the first housing 14 by any appropriate technique, such as machining. The first cavity 18 can be generally cylindrical, and the second cavity 20 can be generally rectangular. Typically, the second cavity 20 can intersect the first cavity 18 at a generally right angle.

Figure 3:
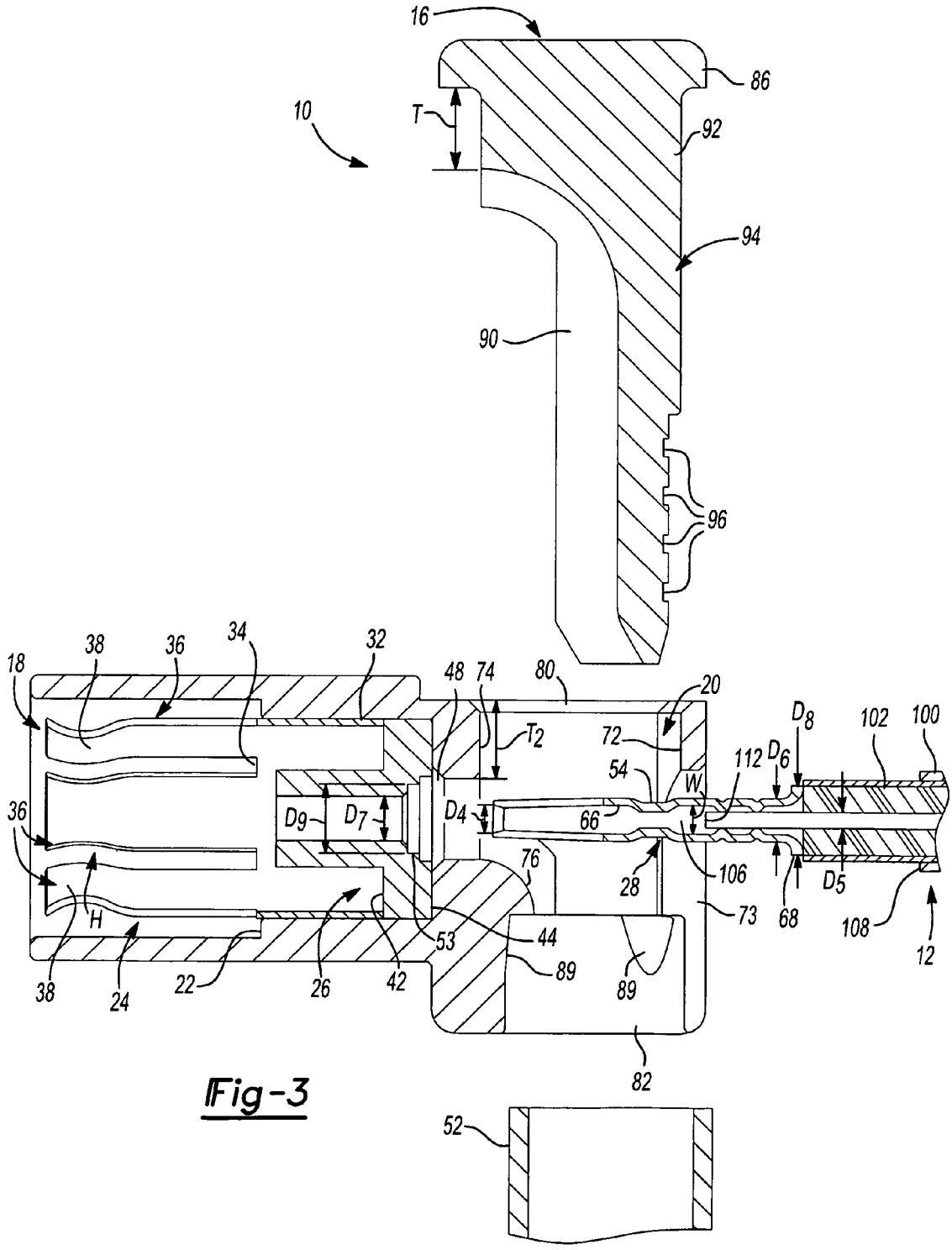
FIG. 3 is a cross-sectional view of the right angle coaxial connector of FIG. 1, taken along line 5-5 of FIG. 1, illustrating a procedure employed to assemble the exemplary coaxial cable to the right angle connector.
Figure 4:
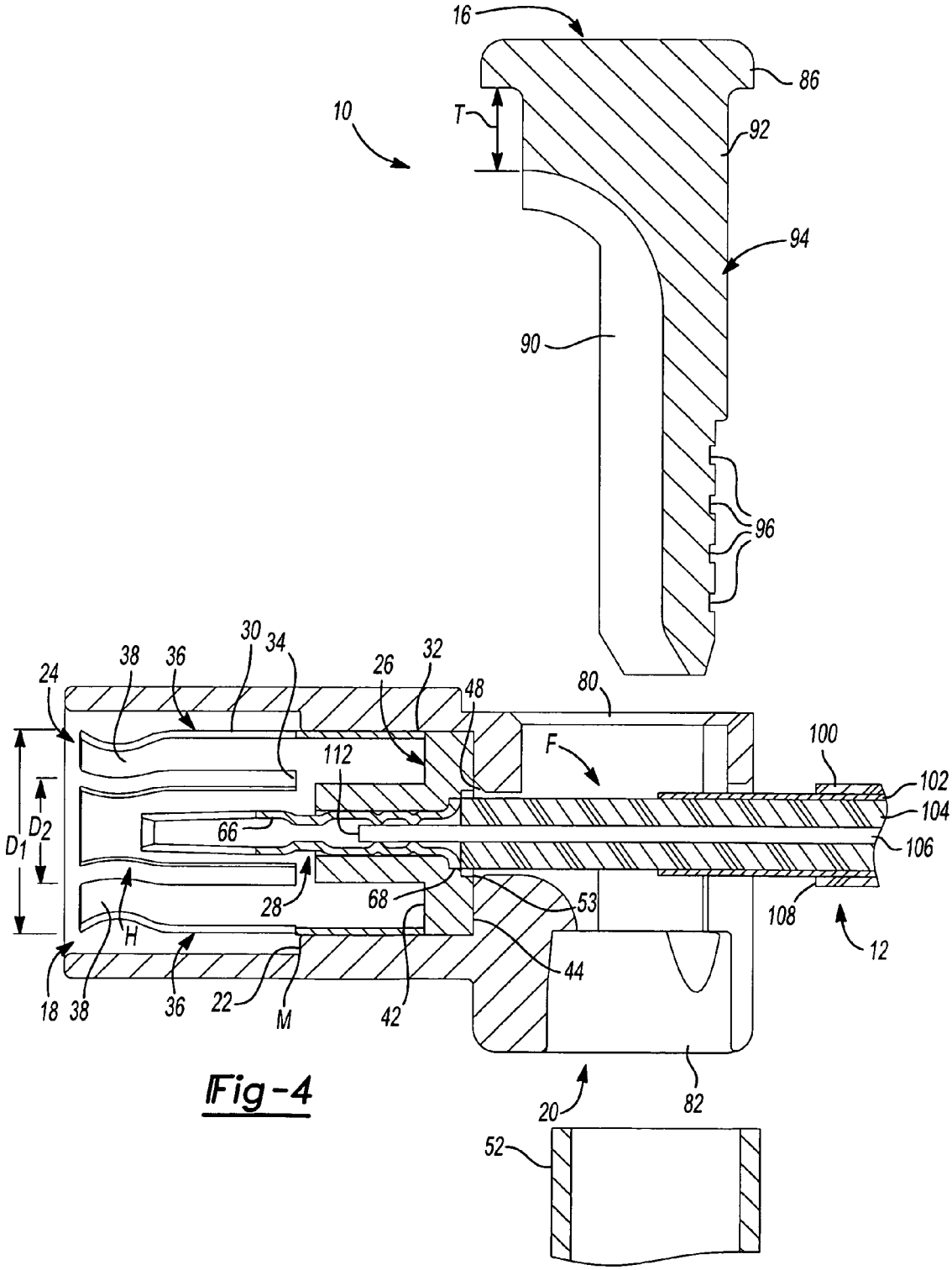
FIG. 4 is a cross-sectional view of the right angle coaxial connector of FIG. 1, taken along line 5-5 of FIG. 1, illustrating another procedure employed to assemble the exemplary coaxial cable to the right angle connector.
Figure 5:
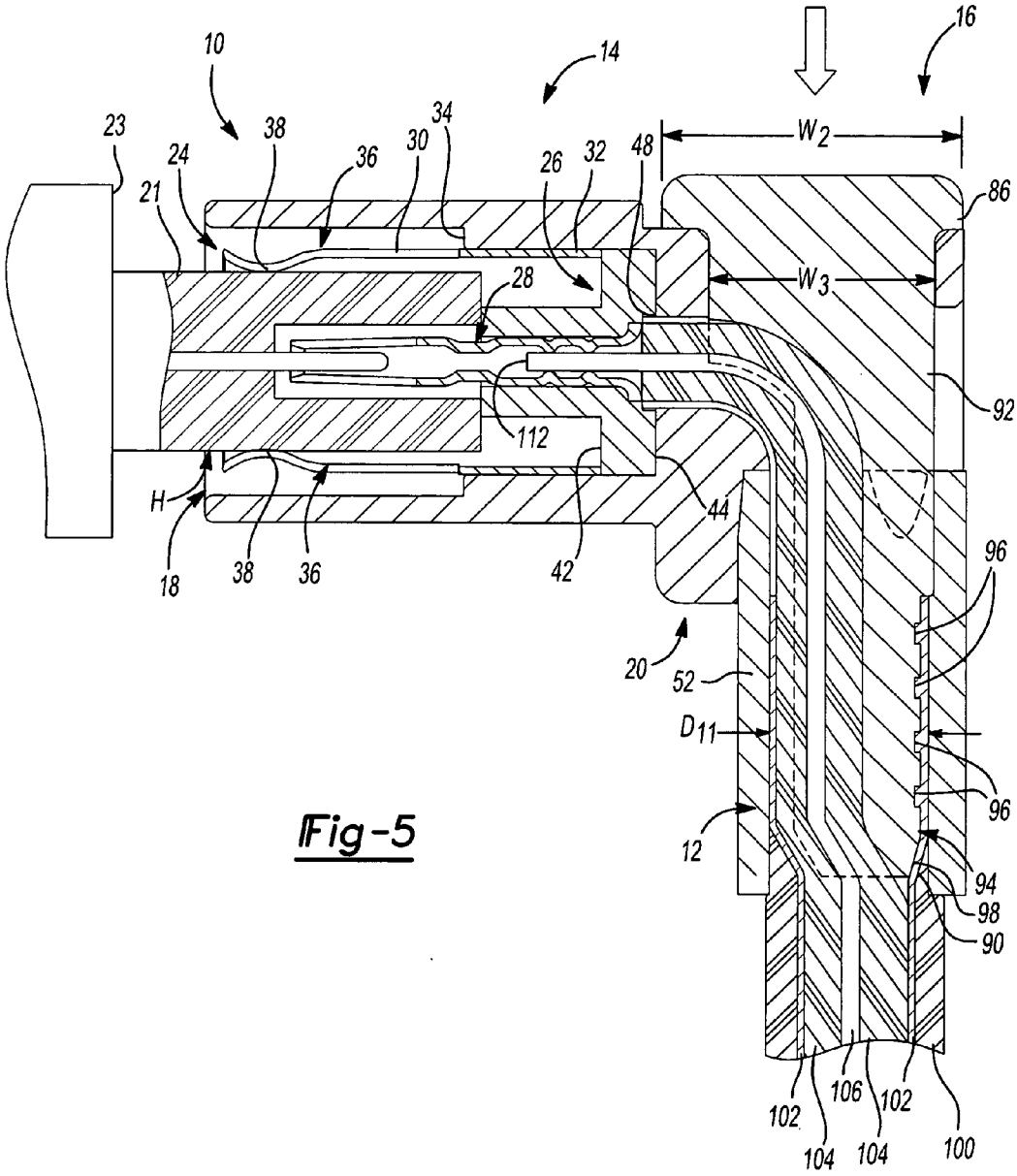
FIG. 5 is a cross-sectional view of the right angle coaxial connector of FIG. 1, taken along line 5-5 of FIG. 1, after the exemplary coaxial cable has been assembled to the right angle coaxial connector.

With continuing reference to FIGS. 1 and 2, and with additional reference to FIGS. 3 and 4, the first cavity 18 can include a reduced diameter D1 at about a midpoint M of the first cavity 18 to create a stepped portion 22 within the first cavity 18 (FIG. 4). The stepped portion 22 can act as a guide to ensure the right angle coaxial connector 10 is properly assembled, as will be discussed in greater detail herein. The first cavity 18 can also include a second reduced diameter D2 adjacent to the second cavity 20 (FIG. 4). The second reduced diameter D2 can be configured to enable the receipt of a selected coupler 21 from device 23 to enable communication between the device 23 and the coaxial cable 12 (FIG. 5). The first cavity 18 can generally be configured to receive a portion of the coaxial cable 12 to couple the coaxial cable 12 to the second cavity 20.

In order to electrically couple the coaxial cable 12 to the second cavity 20, an outer conductive tube 24, an inner insulative member 26, and a center contact or central conductor 28 can be disposed in the first cavity 18. The outer conductive tube 24 can be generally cylindrical, and can include a first end 30 and a second end 32. The first end 30 can include a plurality of slots 34 that can define a plurality of flexible members 36. Each of the flexible members 36 can include a curved tip 38 that forms an opening (generally indicated by 40) with a reduced diameter (FIG. 2). The reduced diameter opening 40 can provide for alignment and retention of the coupler 21 within the outer conductive tube 24 as the slots 34 can enable the plurality of flexible members 36 to deflect outwardly for receipt of the coupler 21. The deflection of the flexible members 36 can provide a holding force H to retain the coupler 21 within the outer conductive tube 24 (FIG. 3). It should be noted that the amount of deflection of the flexible members 36 can be dictated by the type of material used to form the outer conductive tube 24. Generally, the outer conductive tube 24 can be formed of a conductive material, such as zinc or copper; however, any suitable conductive material could be used. The outer conductive tube 24 can be positioned within the first cavity 18 such that the outer conductive tube 24 rests on the stepped portion 22, adjacent to the inner insulative member 26.

The inner insulative member 26 can be generally cylindrical and can define a first end 42, a second end 44 and a throughbore 46. Generally, the inner insulative member 26 can be retained within the stepped portion 22 of the first cavity 18 such that the first end 42 can be positioned adjacent to the outer conductive tube 24, and the second end 44 can be adjacent to the second reduced diameter D2 so that the throughbore 46 can be aligned with an opening 48 defined by the second reduced diameter D2 (FIG. 3). The inner insulative member 26 can be formed of any non-conductive material, either polymeric or metallic, such as polypropylene.

The first end 42 of the inner insulative member 26 can include a projection 50. The projection 50 can extend from the first end 42 into the first cavity 18. The projection 50 generally has a length L, which can be any length appropriate to support the central conductor 28, as will be discussed in greater detail herein (FIG. 2). The second end 44 of the inner insulative member 26 can include a countersunk surface 53 surrounding the throughbore 46 (FIG. 3). The countersunk surface 53 can be used to couple the central conductor 28 to the inner insulative member 26. The throughbore 46 can extend through the projection 50 to the countersunk surface 53 for receipt of the central conductor 28 therethrough.

The central conductor 28 can be generally cylindrical, with a central projection flange 54. The central conductor 28 can further include a first end 56 and a second end 58 disposed adjacent to the central projection flange 54 and a throughbore 60. Typically, the central conductor 28 can be formed from a conductive material, such as zinc or copper; however, any appropriate conductive material could be used. The central projection flange 54 can have an enlarged width W, which can be larger than the diameter of the throughbore 46 of the inner insulative member 26 to provide a locating feature for the assembly of the central conductor 28 to the inner insulative member 26 (FIG. 3). The first end 56 can include at least one slot 62 to form at least one or a plurality of flexible members 64 (FIG. 2). The flexible members 64 can serve to guide the coupler 21 of the device 23 into the throughbore 60. The first end 56 generally has a diameter D4, which can be slightly larger than a diameter D5 of the coaxial cable 12, as will be discussed further herein (FIG. 3).

The second end 58 of the central conductor 28 can include a main portion 66 that has a diameter D6, which can be larger than the diameter D5 of the coaxial cable 12, but smaller than a diameter D7 of the throughbore 46 of the inner insulative member 26 to enable the main portion 66 of the second end 58 of the central conductor 28 to be retained within the inner insulative member 26. An annular flange 68 can be formed at an end 69 of the main portion 66. The annular flange 68 can have a diameter D8, which is greater than the diameter D7 of the throughbore 46 of the inner insulative member 26, but smaller than a diameter D9 defined by the countersunk surface 53 of the inner insulative member 26. Thus, the diameter D8 of the annular flange 68 can serve to retain the central conductor 28 to the inner insulative member 26 and provide a locating feature during the assembly of the central conductor 28 to the inner insulative member 26. The annular flange 68, once assembled to the inner insulative member 26, can also provide a locator for the assembly of the coaxial cable 12 within the first cavity 18, as will be discussed in greater detail herein.

The second cavity 20 of the first housing 14 can be generally rectangular, and can include a curved groove 70 formed on a first surface 72 (FIG. 2). The curved groove 70 can generally be sized to mate with the second housing 16, as will be described in greater detail herein. On a second surface 74 of the second cavity 20, a curved lip 76 can be formed (FIG. 3). The curved lip 76 can extend from the second surface 74 to form a bottom section of a passageway for the coaxial cable 12. The curved lip 76 can be generally positioned adjacent to the first cavity 18 to enable the coaxial cable 12 to contact the curved lip 76 to assist in forming the coaxial cable 12 into a right angle. The second cavity 20 may also include an opening 73 formed on the first surface 72 to enable the coaxial cable 12 to enter the first housing 14. The second cavity 20 can also generally define a first opening 80 and a second opening 82. The first opening 80 can be sized to enable the receipt of the second housing 16 therethrough, and the second opening 82 can be sized to enable the second housing 16 and the coaxial cable 12 to pass therethrough.

The second housing 16 can generally slidably engage the second cavity 20 of the first housing 14. The second housing 16 can be formed of a conductive material, such as zinc; however, any appropriate conductive material could be used. The second housing 16 can include a cap 86 coupled to a sleeve 88. The cap 86 can be integrally formed with the sleeve 88, through die-casting for example; however, the cap 86 could also be coupled to the sleeve 88 through any appropriate technique, such as welding, bonding, press-fitting or mechanical fasteners. The cap 86 can be rectangular, and can have a width W2, which is larger than a width W3 of the first opening 80 of the second cavity 20 to enclose the second cavity 20 (FIG. 2). The cap 86 can also have a thickness T, which can be equivalent to a thickness T2 of the second cavity 20 of the first housing 14 above the opening 48 defined by the second reduced diameter D2 to secure the cap 86 within the second cavity 20 (FIG. 3). Generally, the sleeve 88 can be formed on the second housing 16 so that once the cap 86 is against the first opening 80 of the second cavity 20 of the first housing 14 the sleeve 88 can be aligned with the opening 48 of the first cavity for receipt of the coaxial cable 12.

The sleeve 88 can have a curved channel 90 for receipt of the coaxial cable 12. The sleeve 88 and the curved channel 90 can generally be formed so that the coaxial cable 12 can form a 90 degree or right angle. However, it will be understood that although the second housing 16 is shown generally to enable the coaxial cable 12 to form a right angle with respect to the first housing 14, the second housing 16 could be modified to enable the coaxial cable 12 to form any desired angle with respect to the first housing 14.

The sleeve 88 can also include a rectangular mating portion 92 formed on an exterior surface 94 of the sleeve 88. The rectangular mating portion 92 can generally be sized to slidably engage the second cavity 20 of the first housing 14 to ensure that the second housing 16 is located and properly retained in the second cavity 20. The sleeve 88 can also include at least one or a plurality of grooves 96 on the exterior surface 94 of the sleeve 88. The grooves 96 are generally configured to engage a portion of the coaxial cable 12, as will be discussed further herein. The sleeve 88 may also include a tip 98. The tip 98 can facilitate the engagement of the second housing 16 with the coaxial cable 12, as will be discussed herein.

Prior to coupling the coaxial cable 12 to the right angle coaxial connector 10, a portion of a jacket or outer insulator layer 100 of the coaxial cable 12 can be removed or stripped from the coaxial cable 12 to reveal an outer conductor layer 102 (FIG. 3). The outer insulator layer 100 can be formed of a non-conductive polymeric material, such as Fluorinated Ethylene Propylene (FEP) Teflon®, and the outer conductor layer 102 can be formed of a conductive material, such as a copper wire coil or screen for example. Next, a portion of the outer conductor layer 102 can be stripped to reveal an inner insulator layer 104, which can be formed of a non-conductive material. Lastly, a portion of the inner insulator layer 104 can be stripped to reveal a center conductor layer 106. The center conductor layer 106 can be formed of a conductive material, such as copper.

After the coaxial cable 12 has been stripped to reveal the outer conductor layer 102, inner insulator layer 104 and center conductor layer 106, the coaxial cable 12 can be coupled to the right angle coaxial connector 10. In order to prepare the right angle coaxial connector 10 for receipt of the coaxial cable 12, the inner insulative member 26 can be positioned within the first cavity 18 of the first housing 14 on the stepped portion 22 so that the projection 50 on the inner insulative member 26 can extend into the first cavity 18. Next, the outer conductive tube 24 can be positioned within the first cavity 18 of the first housing 14 on the stepped portion 22 until the outer conductive tube 24 abuts the first end 42 of the inner insulative member 26.

In order to couple the coaxial cable 12 to the assembled right angle coaxial connector 10, the coaxial cable 12 can be fed into the opening 73 formed in the second cavity 20 of the first housing 14 (FIG. 3). First, the central conductor 28 can be crimped to the central conductive layer 106 of the coaxial cable 12 and inserted through the opening 73 of the second cavity 20 and the throughbore 46 of the inner insulative member 26 until the projection 50 of the inner insulative member 26 abuts the central projection flange 54 and the annular flange 68 is retained in the countersunk surface 53. Typically, the center connector layer 106 of the coaxial cable 12 can be inserted into the central conductor 28 until an end 112 of the center conductor layer 106 abuts the central projection flange 54. The inner insulator layer 104 of the coaxial cable 12 can generally abut the annular flange 68 of the central conductor 28 when the center conductor layer 106 is fully assembled within the central conductor 28.

Next, after the coaxial cable 12 is crimped into the central conductor 28 and the central conductor 28 is secured within the inner insulative member, a force F can be applied to the coaxial cable 12 within the second cavity 20 to bend the coaxial cable 12 downward, so that the coaxial cable 12 can exit the second opening 82 of the second cavity 20. Then, the tip 98 of the sleeve 88 of the second housing 16 can be inserted between the outer conductive layer 102 and the inner insulator layer 104 so that the sleeve 88 of the second housing 16 can be slid between the outer conductive layer 102 and the inner insulator layer 104. Generally, the outer conductive layer 102 can be flared outward so that the outer conductive layer 102 is retained in the grooves 96 of the sleeve 88.

Once the sleeve 88 is positioned between the outer conductive layer 102 and the inner insulator layer 104 of the coaxial cable 12, the second housing 16 can be inserted until the cap 86 seals the first opening 80 of the second cavity 20 of the first housing 14, as best shown in FIG. 5. Once the second housing 16 is against the first opening 80 of the second cavity 20, the crimp tube 52 can be positioned over the second housing 16 and over to an edge 108 of the outer insulator layer 100. The crimp tube 52 can have a diameter D10, which can be greater than a diameter D11 of the assembled second housing 16 and outer conductive layer 102 of the coaxial cable 12, to enable the crimp tube 52 to fit around the second housing 16, and thus the coaxial cable 12 (FIG. 5). The crimp tube 52 can be composed of any appropriate conductive polymeric or metallic material that is capable of deformation before failure of the material, such as aluminum.

Generally, once the crimp tube 52 is positioned over the second housing 16, a tool (not shown) can be used to deform the crimp tube 52 to lock the coaxial cable 12 within the right angle coaxial connector 10. The crimp tube 52, when crimped, retains the coaxial cable 12 via the outer conductive layer 102 to the second housing 16. The close fit and length of the crimp tube 52 and second opening 82 can provide lateral support if the coaxial cable 12 is pulled in any direction. There can also be at least one or three tapered flats 89 defined in the second opening 82 to maintain good electrical contact between the crimp tube 52 and the first housing 14. Generally, as the crimp tube 52 is inserted, the three tapered flats 89 can contact the crimp tube 52 and slightly deform it, which generates a contact force to maintain electrical contact even through environmental changes. Good electrical contact can improve radio frequency (RF)

performance of the right angle coaxial connector 10, and through the tapered flats 89, the crimp tube 52 can be electrically connected to first housing 14.

With the right angle coaxial connector 10 fully assembled, the opening 40 defined by the flexible members 36 or the outer connective tube 24 can be slid into position with the coupler 21 of the device 23 to couple the coaxial cable 12 to the device 23. Generally, the coaxial cable 12 can be configured such that the outer insulator layer 100 ends approximately adjacent to the tip 98 of the sleeve 88 of the second housing 16, as best shown in FIG. 4.

The description of these teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A connector comprising:

a coaxial cable segment for transmitting energy therethrough, the coaxial cable segment including a center conductor, an outer conductor disposed about the center conductor, an inner insulator disposed between the center conductor and the outer conductor, and an outer insulator disposed about the outer conductor, the coaxial cable segment having an end portion wherein at least a portion of the outer insulator is stripped from the outer conductor and wherein the center conductor extends outwardly away from a point at which inner insulator terminates;

a first housing defining a first cavity and a second cavity that intersects with the first cavity, the end portion of the coaxial cable segment being received into the first cavity through the second cavity and an opposite end portion of the coaxial cable exiting through the second cavity; and a second housing having a conductive sleeve, the second housing being received into the first housing such that the conductive sleeve exits the first housing through the second cavity and electrically engages the outer conductor of the end portion of the coaxial cable segment, wherein the inner insulator of the end portion of the coaxial cable segment is received within the conductive sleeve and wherein the conductive sleeve of the second housing is disposed concentrically about the central conductor of the end portion of the coaxial cable segment;

wherein a conductive tube disposes in the first cavity, the conductive tube defining a throughbore and having a flexible end, the flexible end deflectable to couple the coaxial cable segment to a device;

wherein an inner insulative member disposes at an end of the first cavity, the inner insulative member including a first end, a second end and a throughbore, the first end including a protrusion extending into the conductive tube and the second end including a countersink.

2. The connector of claim 1, further comprising:

a center contact disposed in the first cavity of the first housing, the center contact defining a throughbore including a first end, a second end, and a central flange, the first end defining a slot, the second end including an annular flange, the central flange positioned on the center contact to engage the protrusion of the inner insulative member, the throughbore configured for receipt of at least a portion of the center conductor of the coaxial cable segment therein.

3. The connector of claim 2, wherein the throughbore of the inner insulative member is sized for receipt of the second end of the center contact until the annular flange of the second end of the center contact contacts the countersink of the inner insulative member and the central flange engages a face of the inner insulative member to couple the center contact to the inner insulative member.

4. The connector of claim 3, further comprising:

a locking member, the locking member defining a throughbore sized to engage the second housing, wherein the locking member is deformable to retain the coaxial cable segment to the connector.

5. The connector of claim 1, wherein the second housing further comprises a conductive cap coupled to the conductive sleeve, the conductive cap configured to enclose a first end of the second cavity.

6. The connector of claim 1, wherein the second cavity of the first housing intersects the first cavity of the first housing at a right angle.

7. A right angle connector for a coaxial cable, the coaxial cable including an outer insulator, an outer conductor, an inner insulator and a center conductor, the right angle connector comprising:

a main housing defining a first cavity and a second cavity intersecting the first cavity at a right angle;

a conductive tube disposed in the first cavity, the conductive tube adapted to couple the coaxial cable to a device;

a center contact disposed in the conductive tube, a portion of the center contact adapted to be electrically coupled to the center conductor of the coaxial cable; and a secondary conductive housing received in the second cavity and extending through the second cavity, the secondary housing adapted to be electrically coupled to the outer conductor of the coaxial cable, the secondary conductive housing adapted to enable the coaxial cable to form a right angle;

wherein the conductive tube includes a first end and a second end, the first end defining a plurality of slots for receipt of a coupler on the device;

wherein an inner insulative member disposes at an end of the first cavity, the inner insulative member including a first end, a second end and a throughbore, the first end including a protrusion extending into the conductive tube, the second end including a counterbore, wherein the second end of the conductive tube abuts the first end of the inner insulative member to retain the inner insulative member within the first cavity of the main housing.

8. The right angle connector of claim 7, wherein the center contact further comprises:

a throughbore including a first end and a second end, the first end defining a slot for receipt of the coupler of the device, the second end including an annular flange; and a central flange positioned on the center contact to locate the center contact within the inner insulative member, wherein the center conductor of the coaxial cable is crimped to the second end of the throughbore.

9. The right angle connector of claim 8, wherein the throughbore of the inner insulative member is sized for receipt of the second end of the center contact until the annular flange of the second end of the center contact contacts the counterbore of the inner insulative member and the central flange engages a face of the inner insulative member to couple the center contact to the inner insulative member.

10. The connector of claim 9, further comprising:

a locking member, the locking member defining a throughbore sized to engage the second housing, wherein the locking member is deformable to retain the coaxial cable to the connector.

11. The connector of claim 9, wherein the second housing further comprises a conductive cap coupled to the conductive sleeve, the conductive cap configured to enclose a first end of the second cavity.

12. A method of forming an angled connection with a coaxial cable comprising:

providing a first housing defining a first cavity and a second cavity, a second housing defining a sleeve, and a central conductor disposed in the first housing;

inserting the central conductor into the first cavity;

removing a portion of an outer insulator of the coaxial cable to expose an outer conductive layer, an inner insulator layer and a central conductive layer;

positioning the central conductive layer of the coaxial cable within the central conductor;

bending the outer conductive layer extending beyond the central conductor to a desired angle;

inserting the second housing into the second cavity so that the sleeve of the second housing is disposed between the outer conductive layer and the inner insulator layer of the coaxial cable; and mechanically coupling the outer conductive layer to the second housing;

wherein the method further comprises:

a crimp tube;

positioning the crimp tube over the second housing after the second housing is inserted into the first housing; and deforming the crimp tube to lock the coaxial cable to the second housing.

13. The method of claim 12, further comprising:

providing an inner insulative member; and sliding the inner insulative member over the central conductor until the insulative member contacts a central flange on the central conductor to couple the inner insulative member to the central conductor.

14. The method of claim 13, further comprising:

providing a conductive tube;

inserting the conductive tube into the first cavity until an end of the conductive tube contacts the inner insulative member to retain the inner insulative member within the first cavity.

15. The method of claim 12, further comprising:

deforming at least a portion of the central conductor containing the central conductive layer of the coaxial cable to lock the central conductive layer within the central conductor.

* * * * *